US006212976B1

(12) United States Patent
Stogner

(10) Patent No.: US 6,212,976 B1
(45) Date of Patent: Apr. 10, 2001

(54) DUPLEX DRILL PIPE WRENCH APPARATUS AND METHOD FOR TOP DRILLING RIG DRILLING OPERATIONS

(76) Inventor: Huey Stogner, P.O. Box 803, Houston, TX (US) 77001

( * ) Notice: Subject to any disclaimer, the term of this patent is extended or adjusted under 35 U.S.C. 154(b) by 0 days.

(21) Appl. No.: 08/921,659

(22) Filed: Aug. 28, 1997

(51) Int. Cl.[7] ..... B25B 13/50
(52) U.S. Cl. ..... 81/57.34; 81/57.16; 81/57.19
(58) Field of Search ..... 81/57.15, 57.16, 81/57.19, 57.24, 57.33, 57.34, 57.35, 57.39, 57.4

(56) References Cited

U.S. PATENT DOCUMENTS

| | | | | |
|---|---|---|---|---|
| 2,760,392 | * | 8/1956 | Paget | 81/57.16 |
| 3,550,485 | * | 12/1970 | Dickmann | 81/57.15 |
| 3,844,547 | | 10/1974 | Lang et al. . | |
| 4,023,449 | * | 5/1977 | Boyadjieff | 81/57.35 |
| 4,082,017 | | 4/1978 | Eckel . | |
| 4,271,730 | * | 6/1981 | Holl et al. | 81/57.24 |
| 4,402,239 | | 9/1983 | Mooney . | |
| 4,497,224 | * | 2/1985 | Jurgens | 81/57.16 |
| 4,585,279 | | 4/1986 | Lemaire et al. . | |
| 4,732,061 | * | 3/1988 | Dinsdale | 81/57.19 |
| 4,811,635 | | 3/1989 | Falgout, Sr. . | |
| 4,843,945 | * | 7/1989 | Dinsdale | 81/57.34 |
| 5,060,542 | * | 10/1991 | Hauk | 81/57.16 |
| 5,351,767 | | 10/1994 | Stogner et al. . | |
| 5,537,900 | | 7/1996 | Schaar . | |

FOREIGN PATENT DOCUMENTS

| | | | | |
|---|---|---|---|---|
| WO 82/00428 | * | 2/1982 | (WO) | 81/57.16 |

OTHER PUBLICATIONS

Varco BJ Automated Iron Roughneck AR–3200 Advertising literature (Jul. 1995) (11 pp).

* cited by examiner

*Primary Examiner*—Eileen P. Morgan
*Assistant Examiner*—Joni B. Danganan
(74) *Attorney, Agent, or Firm*—Daniel N. Lundeen

(57) ABSTRACT

A combination torque wrench and positioning assembly are used to provide the torque wrench function to both make up/break out pipe stands and to service drill string. While serving to make up/break out pipe stands, the wrench is positioned over and used in conjunction with a rotary or powered mouse-hole. When servicing drill string, the wrench is positioned over the drill bore rotary table. The combination of the present apparatus allows the rapid make up of pipe stands having individually torqued connections, eliminates the need for top drive torquing, and reduces the need for tongs and spin chains to handle drill pipe.

19 Claims, 3 Drawing Sheets

DUPLEX DRILL PIPE WRENCH APPARATUS AND METHOD FOR TOP DRILLING RIG DRILLING OPERATIONS

FIELD OF THE INVENTION

The present invention pertains to oil rig drill pipe handling devices and procedures. More particularly, it pertains to an apparatus including a duplex drill pipe wrench for both making up and breaking out drill pipe joints, and a method of use in combination with a rotary mouse-hole tool for making up and breaking out multi-joint stands of drill pipe. Still more particularly, the present invention pertains to a device and an improved method for both making up and breaking out multi-joint stands of drill pipe during top drive drilling operations.

BACKGROUND OF THE INVENTION

Oil well drilling operations usually involve rotating a string of drill pipe composed of individual sections called "joints," each typically 30 feet in length, which carries a drill bit assembly at its lower end. As the bit bores deeper into the earth, additional joints of pipe are added to the string (see A Primer of Oilwell Drilling, (1979) Petroleum Extension Service, University of Texas, Austin, Pub., 1979, incorporated herein by reference).

The "top drive" is a relatively recent development in mechanisms for rotating a drill pipe string that has gained widespread acceptance in the oil and gas drilling industry. A top drive drilling mechanism and ancillary equipment are supported by and below the traveling block of a drilling rig. The traveling block provides for moving the top drive vertically along the well bore axis to enable connecting it to the drill string. The top drive mechanism includes a drive mechanism which turns a coupling to which the upper end of the pipe string can be connected. Top drive drilling procedures eliminate the need for the long "kelly joint" previously used for connecting a drive mechanism to a drill pipe string, and the need for disconnecting the kelly joint from the drill string each time it is necessary to add or remove a single section from the drill string. Also, use of a top drive permits drill pipe to be added to the drill string in multi-joint "stands" of two or three sections of drill pipe at a time, with a corresponding reduction in time wasted and man hours expended by not having to cease drilling as often to add drill pipe.

The mouse-hole and the rat-hole are rig features previously developed in connection with rotary table drilling rigs. A mouse-hole is a substantially vertical tubular sleeve extending below the drilling rig floor with its upper opening adjacent the drill bore. The mouse-hole is used to hold the next joint of drill pipe which is to be added to the drill string. The rat-hole is a somewhat larger diameter (and often longer) tubular sleeve also located in the drilling rig floor and serves as a receptacle for the kelly.

To realize the advantages obtainable with top drive systems, it is desirable to make-up stands of drill pipe while drilling operations are in progress. However, for a variety of reasons, the task of making up multiple stands of up to three sections of drill pipe often cannot be completed fast enough to keep up with drilling operations. Consequently, the maximum efficiencies possible from use of top drive drill procedures are not always obtained. Therefore, an important step in a top drive drilling procedure is the make up or connection of one pipe joint to another, in advance.

A problem attendant with this step is the need to insure the application of the proper amount of torque to the ends of the joints being connected. Usually, torque is measured only overall, when the multi-joint stand is attached to the top drive unit, in which case, there is no measurement or control of torque at each connection between joints in the stand.

Another problem commonly encountered when making up "double" and "thribble" (as they are called in the art) stands for top drive drilling is to ensure proper alignment of the "tool joint" ends. Each section of drill pipe has an externally threaded coupling at one end, called a "pin", and at the other end, an internally threaded coupling called a "box." Drill strings typically are assembled with each joint in the string joint disposed pin end down. Misalignment of the pin and box ends of adjacent joints can slow the task of making up a stand and can lead to galling or other thread mutilation conditions.

Some top drive drilling procedures actually require the use of the top drive in the make up of joint stands. Those types of procedures that require participation of the top drive in operations other than drilling may not be making full use of the advantages top drive drilling is now recognized as offering the industry.

A need exists in the industry for alternatives and improvements in the procedures and equipment available in top drive drill rigs to enable more rapid assembly of multi-joint stands of drill pipe, while drilling operations are concurrently proceeding. Such improvements desirably should include procedures and devices for (1) accurately and efficiently aligning the pin and box ends of two joints to be connected, (2) threading those joints together (or unthreading them for breakout), (3) applying a determined amount of torque to finish the connection (or break the connection for a backout), and (4) not requiring participation of the top drive to accomplish any of the make up operations. Further, the equipment should be flexible for use with existing drill rig arrangements and procedures to reduce the need for retraining of rig personnel.

The recognized advantages of top drive drilling in fact have motivated the industry to develop innovative technologies and improvements which support or attempt to optimize those advantages. Specifically, the advantage of being able to attach to the drill string multiple sections of drill pipe at-a-time has led to the development of new devices and methods for making up and breaking out multi-joint drill pipe stands.

Kennard (U.S. Pat. No. 3,293,959) discloses a device mounted over the rat-hole on a drilling platform. Kennard describes using a kelly joint for rotation, a housing and means for supporting a length of pipe to be added to the drill string, and clamping means for preventing the pipe from rotation during make-up with the kelly joint. The housing is mounted on spring legs to resiliently support and upwardly bias the joint to be made up relative to the kelly joint. A winch having a cable and stabbing hook swings the kelly joint into position over the housing and vertically aligns it with the pipe joint supported by the housing.

Stogner et al. (U.S. Pat. No. 5,351,767, herein incorporated by reference) teach an apparatus and method where multi-joint stands of drill pipe are made up and broken out in a drilling rig using a rig's mouse-hole feature. In Stogner et al., make up and break out are accomplished by using a powered mouse-hole to rotate a lower joint of pipe relative to an upper joint, which is held in alignment and prevented from rotating by tong assembly. However, this apparatus and method do not accomplish the controlled torquing of each connection between joints in a stand.

Additionally, Stogner et al. describe a rotating mouse-hole tool for use with a standard mouse-hole in situations where the drilling rig does not have a powered mouse-hole available. The rotating mouse-hole tool itself provides the rotational force for threading and unthreading joint of drill pipe. The rotating mouse-hole tool of Stogner et al. is to be used with a particular type of drill pipe that has a neck formed by increasing the diameter of the coupling end of the pipe (described in Stogner et al. as known in the art as "a tool joint box").

The PHANTOM MOUSE® (International Tool Co., Ltd., Houston, Tex.) is a commercially available example of a rotating mouse-hole tool for tool joint make up and break out. However, rotating mouse-hole tools generally do not make up the joint connection to full torque, and a stand of pipe is tightened to full make up torque only after it is inserted into the drill string by means of the top drive. Make up torque is applied overall to the stand, not individually to each connection. This procedure consumes top drive operating time and can result in variation in the make up torque of individual connections in stands of more than two sections of drill pipe, or in the connection of the stand to the drill string. Another limitation of the rotating mouse-hole tool is that it is not easily usable on drill string.

SUMMARY OF THE INVENTION

The object of the apparatus of the present invention is a duplex drill pipe wrench and positioner combination for use with a powered mouse-hole or rotary mouse-hole tool in a top drive drilling procedure. The present invention makes it possible on top drive rigs for the drill pipe connections made up in a powered mouse hole or using a rotating mouse-hole tool to be torqued up to a full 70,000 foot pounds for 3-inch drill pipe through 8½-inch drill collars. This means that pipe stands made up using the present apparatus and method can be made up at full torque to be ready to go down hole when needed without any further torquing.

Another object of the present invention is to eliminate any need for spinning chains or tongs, hence eliminating prior safety problems associated with tongs and chains.

Another object of the present invention is a procedure allowing drilling crews to keep on drilling and making hole while they simultaneously make up and set back stands of drill pipe, or break out and lay down excess drill pipe that has been left in the derrick. The present duplex drill pipe wrench and positioner combination is mounted on the drill rig so that it may be positioned either just above the powered mouse-hole (or a rotating mouse-hole tool) or the rotary table (over the well bore). In this configuration the duplex drill pipe wrench can be used to service either drill pipe in the mouse-hole or drill pipe in the drill string.

The apparatus of the present invention is a duplex drill pipe torque wrench assembly, which is connected to a wrench holder. The wrench holder is located on a drilling rig so that it can be used to position the bore of the jaws of the wrench in line with the vertical bore of a mouse-hole and/or the vertical bore of the well. The duplex drill pipe wrench serves the dual purpose of: (1) a torque wrench and (2) a backup wrench. Additionally, the present wrench serves the dual purpose of: (1) aligning and holding the mating ends of two sections of drill pipe while they are threaded in or threaded out, and (2) applying the proper torque across a mated connection to make up the connection or to break out the connection. The present invention also serves the dual purpose of: (1) make up/break out of pipe stands over a mouse-hole, and (2) servicing drill string in the well bore over a rotating table.

The present invention is a drill pipe handling apparatus for use on a drilling rig comprising a duplex drill pipe wrench movably connected to a positionable wrench holder located on a drilling rig within reach of a mouse hole and the rotating table, and capable of alternatively positioning the wrench over the bore of either.

The duplex drill pipe wrench has a set of upper jaws and a set of lower jaws stacked in a horseshoe-like configuration to have concentric bores, with their open ends aligned for receiving, aligning and releaseably engaging the opposing ends of two drill pipes. The stacked jaw sets have a biasing means between them which allow for adjusting the distance between them as the wrench performs its threading or unthreading function. This biasing may be accomplished by any of a number of means known to one of skill in the art including adjustable: spring loaded standoffs; shock absorbers; and scissor jacks.

Each set of jaws is hydraulically activated to reversibly engage the end of a drill pipe adjacent the coupling. Also, each set of jaws has a first jaw that is manually adjustable to concentrically position different diameters of pipe in the bore of the jaws. The first jaw may be manually positioned by a number of means known in the art, including a screw thread, a detent and a lock pin. The second jaw is hydraulically positionable by activation of a hydraulic piston connected to it. Additionally, the upper set of jaws of the stacked horseshoe configuration is reversibly rotatable relative to the lower set of jaws about the axis of the concentric bore through about 30 degrees by means of a hydraulic piston. The purpose of this feature is to apply the torque necessary to make up or break out joint connections. A housing contains the stacked jaw sets as an assembly and can provide a mount for the assembly's controls.

The positionable wrench holder of the present invention comprises an upright post mounted on the rig, having an arm with one end connected to the upright post and extending radially outward. The arm is positionable up and down the length of the post, and also rotatable around the girth of the post. Further, the arm is movably connected to the duplex drill pipe wrench. Alternatively, the arm of the positionable wrench holder may comprise a track on which the duplex drill pipe wrench is movably connected by wheels for positioning the wrench radially with respect to the post. Additionally, the arm and post may comprise a crane having tackle for connecting to and suspending the duplex drill pipe wrench from the arm at various heights, and/or for positioning the wrench radially with respect to the post.

A further object of the present invention is a method for making up a connection between two individual sections of drill pipe, where each section has a complementary threaded pin and box coupling at either end. The steps of this method include providing a drilling rig mouse-hole with means for rotating a drill pipe; inserting a first drill pipe partially into the mouse-hole; and engaging the first drill pipe in the mouse-hole rotational means. Then, using the positionable wrench holder, the duplex drill pipe torque wrench is positioned to receive the upper coupling of the first drill pipe, align its axis with that of the bore of the wrench jaws. After receiving and aligning the upper coupling, the first drill pipe is engaged adjacent the upper coupling with the lower jaws of the wrench.

Next, a second drill pipe is suspended vertically in line with the axis of the first drill pipe, with the complementary coupling of the second drill pipe down and in proximity to be received, aligned and engaged by the upper jaws of the duplex drill pipe wrench. The second drill pipe is received, aligned and engaged by the upper jaws of the wrench in a manner similar to the first pipe. Then, the wrench is adjusted to partially disengage the first drill pipe to allow it to rotate along its axis while maintaining it alignment with the second pipe. The second drill pipe continues to be held fixed to prevent its rotation. This action, in combination with the biasing means allows mating of the complementary couplings of the two drill pipes.

The mouse-hole rotational means is then activated to rotate the first drill pipe and thread the complementary couplings together. The mouse-hole rotating means is then deactivated after the complementary couplings are fully threaded together. The wrench is then readjusted to fixably engage the first drill pipe to prevent rotation along its axis, and the connection between the two drill pipe sections is made up to full torque by the torquing means of the duplex drill pipe wrench to fully make up an individual connection between the two sections of drill pipe.

While a number of objects and advantages are disclosed above, it is well within the ability of one skilled in the art, in view of the present teachings, to conceive of additional objects and advantages that are still within the scope and spirit of the invention as a whole as disclosed herein.

The drawings are not necessarily to scale and certain features of the invention may be exaggerated in scale or shown in schematic form in the interest of clarity and conciseness. It will be readily apparent to one skilled in the art that various substitutions and modifications may be made to the invention disclosed herein without departing from the scope and spirit of the invention.

DETAILED DESCRIPTION OF THE INVENTION

Figure 1:
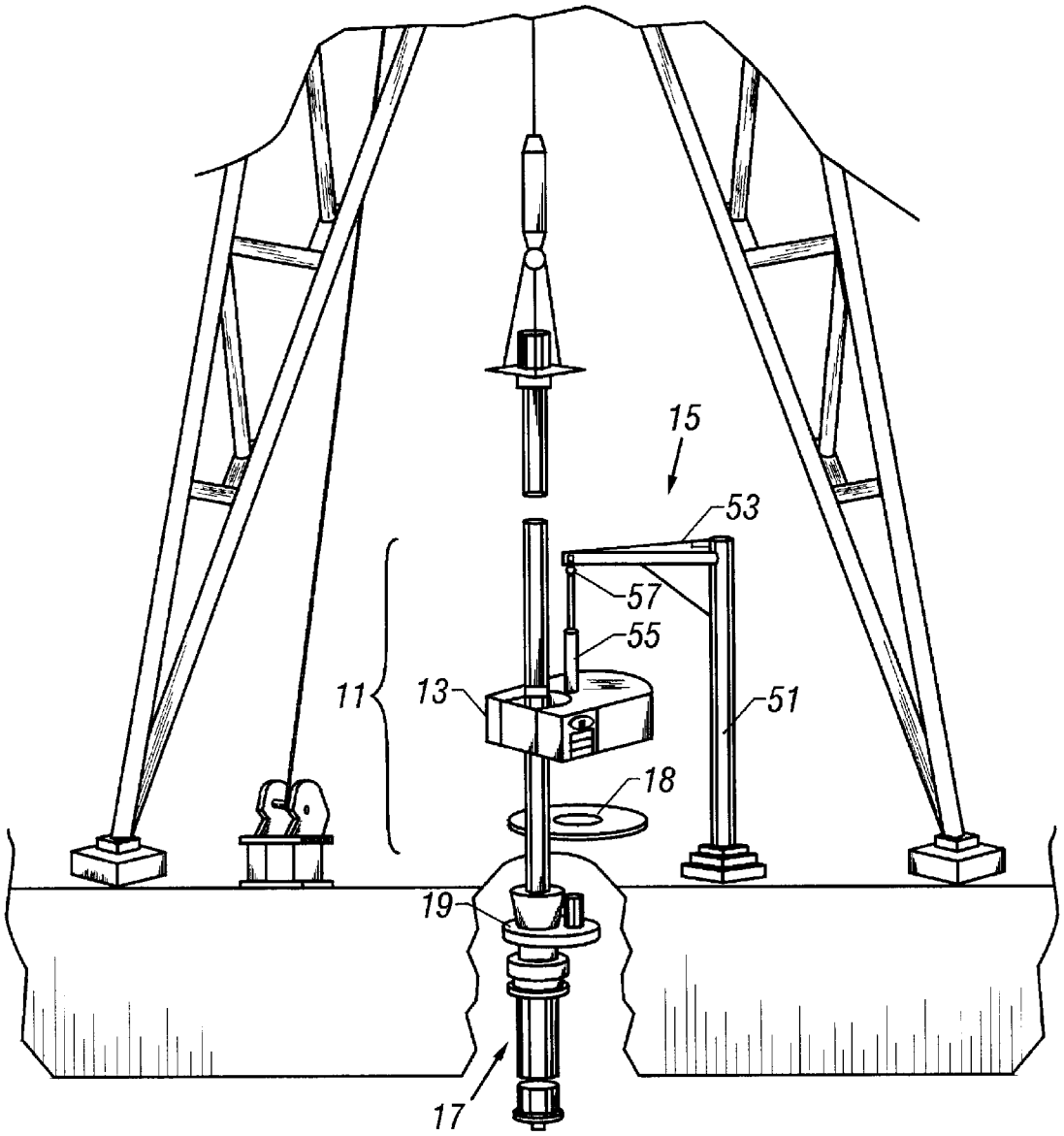
FIG. 1 shows the apparatus of the present invention as a crane and wrench assembly mounted on the deck of a drilling rig, and positioned over a powered mouse-hole for servicing drill pipe stands. Also shown in the figure is the proximity of the rotary table and well bore within reach of the crane.

Referring to FIG. 1, in a preferred embodiment, the drilling rig apparatus 11 of the present invention comprises a duplex drill pipe wrench 13 connected to a wrench holder 15 located on a drilling rig within reach of a mouse-hole 17 and a drill pipe rotator tool 19. The duplex drill pipe wrench 13 is positionable in three dimension by means of its combination with positionable wrench holder 15. It is a feature of this embodiment that the positionable wrench holder 15 is located on the drilling rig within reach of and capable of positioning the duplex drill pipe wrench 13 alternatively over both mouse-hole 17 and the vertical axis of well bore rotary table 18.

Figure 2:
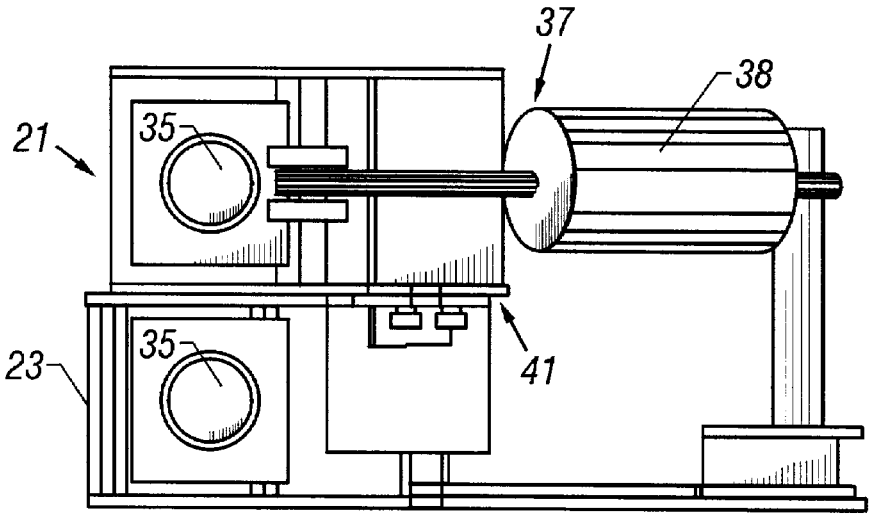
FIG. 2 is a side view of the stacked jaw sets of the duplex drill pipe wrench shown without the housing.
Figure 3:
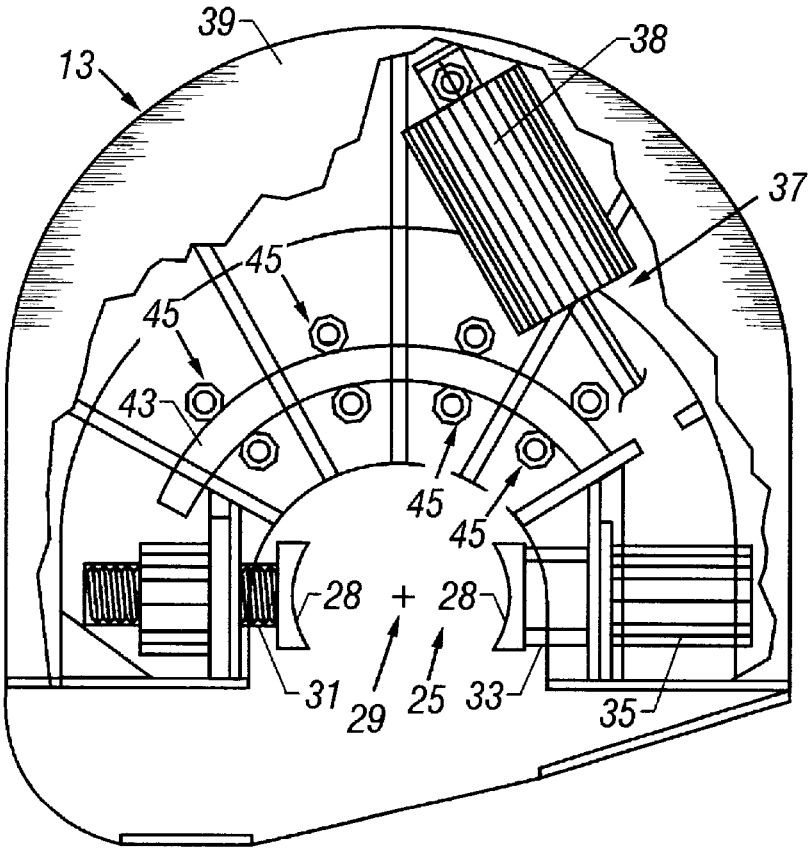
FIG. 3 is a cut-away, superior view of the duplex wrench through the housing and with the upper jaw set and head of torque piston removed. Shown are the lower jaws, the horseshoe-like open end alignment feature, and jaw and housing shims for aligning drill pipe in the wrench. Particularly shown are a curved rail-slot concentric to the bore (+) of the jaws and rail-guides.
Figure 4:
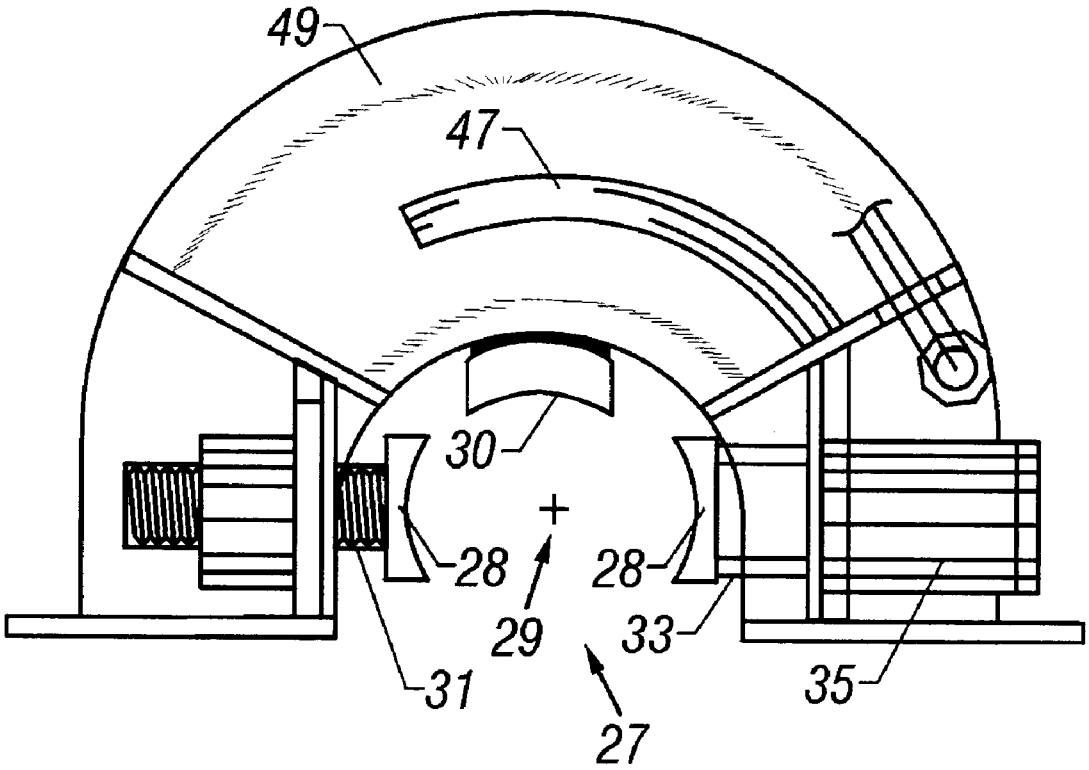
FIG. 4 is a cut-away type superior view of an upper jaw set without the housing, torque piston cylinder and lower jaw set. Shown as if looking through the jaw set is a curved rail, the curvature of which is concentric to the bore of the jaws.

Referring to FIGS. 2 to 4, the duplex drill pipe wrench 13 has a set of upper jaws 21 and a set of lower jaws 23 each constructed in a horseshoe-like configuration. Jaw sets 21 and 23 are stacked one upon the other and configured to have a concentric bore 29 (indicated by the + sign), and to have open ends 27 and 25 aligned for receiving, aligning and releaseably engaging the mating ends of two drill pipes (not shown). Receiving and aligning the end coupling of a joint is facilitated by jaw shims 28 and bore shim 30 in each jaw set. Use of appropriate shims allows the axis of different diameter pipe to be aligned concentrically with the bore 29 of wrench 13. Each set of jaws is hydraulically activated to engage or release the end of a section of drill pipe.

In the preferred embodiment, each set of jaws has a first, manually positionable jaw 31 and a second jaw 33 that is hydraulically positionable by activation of a hydraulic piston connected thereto. Jaw 31 is manually positionable by any of a number of means known in the art, including a means selected from the group consisting of: a screw thread, a detent and a lock pin. Alternatively, both jaws could be hydraulically positionable. The jaw sets are reversibly rotatable relative to each other about the axis of the concentric bore by means of a pivoting interface.

In the preferred embodiment, one set of jaws is reversibly rotatable relative to the other set of jaws by means of hydraulic torque cylinder assembly 37, which rotates the stacked jaw sets through about 30 degrees relative to each other. Rotation is centered on the concentric axis 29 of the jaw sets by means of pivoting interface 41. In the preferred embodiment, pivoting interface 41 is comprised in the lower jaw set 23 of rail-slot 43 and rail-guides, and in the upper jaw set 21 of pivot rail 47. Additionally, there may be a friction reducing surface 49 attached to one or both sides of the pivoting interface 41. Housing 39 contains the stacked jaw sets and mounts the controls for operating the wrench. In the preferred embodiment, the lower jaw set 23 is fixed relative to housing 39 and the upper set 21 of the stacked horseshoe configuration is reversibly rotatable relative to lower jaw set 23.

Referring back to FIG. 1, in the preferred embodiment, the positionable wrench holder 15 comprises an upright post 51 mounted on the rig floor, and having an arm 53 with one end connected to the upright post and extending radially outward. It is preferred that the combination of arm 53 attached to post 51 permits rotation of the arm 53 about the vertical axis of post 51. Additionally, it is preferred that arm 53 be variously positionable through the height of post 51. Means for either of these latter two preferred features are known and readily accomplishable by one of ordinary skill in the art. The other end of arm 53 is connected to duplex drill pipe wrench 13. The combined assembly permits the movement and positioning of duplex drill pipe wrench 13 at appropriate locations within the three dimensional reach of wrench holder 15. In the preferred embodiment, the positionable wrench holder 15 combination of arm 53 and post 51 comprises a crane having tackle 55 for connecting to and suspending the duplex drill pipe wrench 13 from arm 53 at various heights, and tackle 57 means for positioning wrench 13 radially with respect to post 51.

In an alternative preferred embodiment, the arm 53 of positionable wrench holder 15 comprises a track and the duplex drill pipe wrench 13 is mounted on wheels for positioning the wrench radially with respect to the post 51. It is envisioned that this embodiment be accomplished in at least two ways. First, the track may be suspended low above the floor of the rig, as in the arm of a crane, and the track pivotably positionable around the post. Or the track may rest on the floor of the rig and be pivotably positionable around a turntable. In this latter embodiment, the duplex drill pipe wrench 13 may be mounted on a wheeled carriage, adjustable to vary the height of the wrench 13.

The preferred method of the present invention is to perform the following procedure simultaneously with top drive drilling operations to accomplish maximum efficiency of the top drive drilling operation. The preferred procedure of using the present invention for making up a connection between two individual sections of drill pipe, each section having complementary threaded pin and box couplings at either end involves the steps of: providing a drilling rig mouse-hole 17 with means for rotating a drill pipe 19. Then a first drill pipe is partially inserted into the mouse-hole 17 and engaged by the mouse-hole rotational tool 19. The duplex drill pipe wrench 13 is positioned using wrench holder 15 to receive the upper end of the first drill pipe engaged in the rotating mouse-hole tool 19. The axis of the first drill pipe is aligned with the bore 29 of lower jaw set 23 by means of shims 28 and 30 in the lower jaw, then the jaw is hydraulically actuated to engage the first drill pipe adjacent the upper coupling with the lower jaws 23 of the wrench 13 sufficiently to retain concentric alignment, but not to prevent rotation.

Using means known in the art, a second drill pipe is suspended vertically in line with the axis of the first drill pipe, with the complementary or mating coupling of the second drill pipe down and in position to be received, aligned and engaged by the upper jaws 21 of the duplex drill pipe wrench 13, in a manner analogous to that for the lower the lower jaws 23. However, engagement of the second pipe joint coupling by the upper jaw set 21 prevents rotation of the second joint.

While holding the second joint fixed, and with the first joint free to rotate around its axis, the mouse-hole tool 19 is actuated to rotate the first drill pipe and thread the complementary couplings together. If an axial bias is required to bring the coupling together to initiate threading, it may be supplied by the action of the mouse-hole tool 19, or accomplished by positioning of wrench 13 by positioner 15. After the joints are fully threaded together, mouse-hole tool 19 is deactivated. The lower jaw set 23 of duplex drill pipe wrench 13 is readjusted to fixably engage the first drill pipe. Then the connection of the two joints is made up to full torque by activating hydraulic piston 38 of torque assembly 37 to rotate the joints through up to 30 degrees relative to each other. The jaws of wrench 13 are released, and the wrench 13 is removed from the drill pipe. The mouse-hole is made to release the drill pipe, and the drill pipe may be lowered further into the mouse hole and the procedure repeated, or it may be removed from the mouse hole.

The breaking out of drill pipe may be accomplished by using substantially the reverse of the make up procedure.

While the above description contains many specificities, these should not be construed as limitations on the scope of the invention, but rather as an exemplification of one preferred embodiment thereof. Many other variations are possible, which would be obvious to one skilled in the art. Accordingly, the scope of the invention should be determined by the scope of the appended claims and their legal equivalents, and not just by the embodiments.

What is claimed is:

1. A duplex drill pipe wrench adapted to be movably connected to a positionable wrench holder located on a drilling rig within reach of a mouse hole and a drill string, comprising:

a set of upper jaws and a set of lower jaws stacked in a horseshoe configuration with open ends aligned and having a concentric bore for receiving, aligning and releasably engaging the opposing ends of two drill pipes;

each set of jaws being hydraulically activated to engage or release the joint end of the drill pipe;

one set of jaws being reversibly rotatable relative to the other set of jaws by hydraulic means;

a housing for containing the stacked jaw sets;

each set of jaws having a first jaw that is manually positionable and a second jaw that is hydraulically positionable by activation of a hydraulic piston connected thereto.

2. The duplex drill pipe wrench of claim 1 wherein the upper set of jaws of the stacked horseshoe configuration is reversibly rotatable relative to the lower set of jaws about the axis of the concentric bore.

3. The positionable wrench holder of claim 1 comprising:

an upright post mounted on the rig;

having an arm with a proximal end movably connected to the upright post and extending radially outward; and the arm being positionable along the length and rotatable around the girth of the post and movably connected to the duplex drill pipe wrench.

4. The duplex drill pipe wrench of claim 3 wherein the arm and post comprise a crane having tackle for connecting to and suspending the duplex drill pipe wrench from the arm at various heights.

5. The duplex drill pipe wrench of claim 3 wherein the arm and post comprise a crane having tackle for connecting to and suspending the duplex drill pipe wrench from the arm at various heights and for positioning the wrench radially with respect to the post.

6. The duplex drill pipe wrench of claim 3, wherein the upright post has a lower end mounted to the rig floor.

7. The duplex drill pipe wrench of claim 1 wherein the upper jaws are fixed and the lower jaws are reversibly rotatable through about 30 degrees relative to the upper jaws.

8. The duplex drill pipe wrench of claim 1 wherein the first jaw is manually positionable by means selected from the group consisting of: a screw thread, a detent and a lock pin.

9. The duplex drill pipe wrench of claim 1 wherein the positionable wrench holder is mounted on the drilling rig within reach of the vertical axis of a mouse-hole and the vertical axis of the well bore.

10. The duplex drill pipe wrench of claim 1, wherein the aligned open ends and concentric bore receive, align and releaseably engage drill pipe diameters ranging from about three inches to eight inches.

11. A method for making up a connection between two individual sections of drill pipe, each section having complementary threaded pin and box couplings at either end comprising the steps of:

providing a drilling rig mouse-hole with means for rotating a drill pipe;

inserting a first drill pipe partially into the mouse-hole;

engaging the first drill pipe in the mouse-hole rotational means;

positioning the duplex drill pipe wrench of claim 1 using the positionable wrench holder of claim 1 to receive the upper end of the first drill pipe, align the axis of the first drill pipe with the bore of the wrench and engage the first drill pipe adjacent the upper coupling with the lower jaws of the wrench;

receiving, aligning and engaging the first drill pipe with the lower jaws of the wrench;

suspending a second drill pipe vertically in line with the axis of the first drill pipe, with the complementary coupling of the second drill pipe down and in proximity to be received, aligned and engaged by the upper jaws of the duplex drill pipe wrench;

receiving aligning and engaging the second drill pipe with the upper jaws of the wrench;

adjusting the wrench to free the first drill pipe to rotate along its axis while holding fixed the second drill pipe to prevent its rotation, and to allow mating of the complementary couplings of the drill pipes;

activating the mouse-hole rotational means to rotate the first drill pipe and thread the complementary couplings together;

deactivating the mouse-hole after the complementary couplings are fully threaded together;

readjusting the duplex drill pipe wrench to fixably engage the first drill pipe to prevent rotation along its axis; and torquing the connection between the two drill pipe sections by the torquing means of the duplex drill pipe wrench to make up a connection between the two individual sections of drill pipe.

12. A method for breaking out a connection between two individual sections of drill pipe in a pipe stand, each section having complementary threaded pin and box couplings at either end comprising the steps of:

providing a drilling rig mouse-hole with means for rotating a drill pipe;

inserting the pipe stand partially into the mouse-hole with the uppermost connection within reach of the apparatus of claim 1;

engaging the pipe stand in the mouse-hole rotational means;

positioning the duplex drill pipe wrench of claim 1 using the positionable wrench holder of claim 1 to receive the drill stand and align its vertical axis with the bore of the wrench at the connection between the uppermost and the next lower drill pipe sections of the drill stand so as to engage the next lower drill pipe adjacent its upper coupling with the lower jaws of the wrench and the uppermost drill pipe adjacent its lower coupling with the upper jaws of the wrench;

applying torque across the connection between the two drill pipe sections using torquing means of the duplex drill pipe wrench to break out the connection between the two individual sections of drill pipe;

adjusting the wrench to disengage the lower jaws sufficiently to allow the lower section of drill pipe to rotate around its axis, while holding fixed the upper drill pipe section to prevent its rotation;

activating the mouse-hole rotational means to rotate the lower drill pipe and un-thread the complementary couplings apart;

deactivating the mouse-hole after the complementary couplings are fully apart;

disengaging the upper jaws of the wrench from the upper section of drill pipe;

removing the upper section of drill pipe; and removing the wrench from the drill pipe section remaining in the mouse-hole.

13. A method for making up or breaking out a connection in a drill string between two individual sections of drill pipe, each section having complementary threaded pin and box couplings at either end comprising the steps of:

suspending the connection in the drill string within reach of the duplex drill pipe wrench of claim 1;

positioning the duplex drill pipe wrench of claim 1 using the positionable wrench holder of claim 1 to receive and align the axis of the drill string with the axis of the bore of the wrench, with the lower end of the upper drill pipe aligned in the upper jaws and the upper end of the lower drill pipe aligned in the lower jaws;

activating the duplex drill pipe wrench to fixably engage the drill pipe joints to prevent rotation around their axis; and torquing the connection between the two drill pipe sections in the proper direction by a torquing means of the duplex drill pipe wrench to make up or break out the connection between the two individual sections of drill pipe.

14. A drilling rig apparatus comprising:

a duplex drill pipe wrench movably connected to a positionable wrench holder located on a drilling rig within reach of a mouse hole and a drill string;

wherein the wrench holder comprises an upright post mounted on the rig having an arm with a proximal end movably connected to the upright post and extending radially outward; and the arm being positionable along the length and rotatable around the girth of the post and movably connected to the duplex drill pipe wrench.

15. The drilling rig apparatus of claim 14, wherein the upright post has a lower end mounted to the rig floor.

16. The positionable wrench holder of claim 14 wherein the arm and post comprise a crane having tackle for connecting to and suspending the duplex drill pipe wrench from the arm at various heights and for positioning the wrench radially with respect to the post.

17. The drilling rig apparatus of claim 14 wherein the arm and post comprise a crane having tackle for connecting to and suspending the duplex drill pipe wrench from the arm at various heights.

18. A method for breaking out a connection between two individual sections of drill pipe in a pipe stand, each section having complementary threaded pin and box couplings at either end comprising the steps of:

providing a drilling rig mouse-hole with means for rotating a drill pipe;

inserting the pipe stand partially into the mouse-hole with the uppermost connection within reach of the apparatus of claim 14;

engaging the pipe stand in the mouse-hole rotational means;

positioning the duplex drill pipe wrench of claim 14 using the positionable wrench holder of claim 14 to receive the drill stand and align its vertical axis with the bore of the wrench at the connection between the uppermost and the next lower drill pipe sections of the drill stand so as to engage the next lower drill pipe adjacent its upper coupling with the lower jaws of the wrench and the uppermost drill pipe adjacent its lower coupling with the upper jaws of the wrench;

applying torque across the connection between the two drill pipe sections using torquing means of the duplex drill pipe wrench to break out the connection between the two individual sections of drill pipe;

adjusting the wrench to disengage the lower jaws sufficiently to allow the lower section of drill pipe to rotate around its axis, while holding fixed the upper drill pipe section to prevent its rotation;

activating the mouse-hole rotational means to rotate the lower drill pipe and un-thread the complementary couplings apart;

deactivating the mouse-hole after the complementary couplings are fully apart;

disengaging the upper jaws of the wrench from the upper section of drill pipe;

removing the upper section of drill pipe; and removing the wrench from the drill pipe section remaining in the mouse-hole.

19. A method for making up or breaking out a connection in a drill string between two individual sections of drill pipe, each section having complementary threaded pin and box couplings at either end comprising the steps of:

suspending the connection in the drill string within reach of the duplex drill pipe wrench of claim 14;

positioning the duplex drill pipe wrench of claim 14 using the positionable wrench holder of claim 14 to receive and align the axis of the drill string with the axis of the bore of the wrench, with the lower end of the upper drill pipe aligned in the upper jaws and the upper end of the lower drill pipe aligned in the lower jaws;

activating the duplex drill pipe wrench to fixably engage the drill pipe joints to prevent rotation around their axis; and torquing the connection between the two drill pipe sections in the proper direction by a torquing means of the duplex drill pipe wrench to make up or break out the connection between the two individual sections of drill pipe.

* * * * *